United States Patent [19]

Jolivet

[11] 4,369,014

[45] Jan. 18, 1983

[54] PANEL HANGER

[76] Inventor: B. N. Jolivet, 4410 Fortune La., Beaumont, Tex. 77705

[21] Appl. No.: 124,629

[22] Filed: Feb. 25, 1980

[51] Int. Cl.[3] ..... E04G 21/14

[52] U.S. Cl. ..... 414/11; 254/4 C; 414/589

[58] Field of Search ..... 414/10, 11, 12, 589, 414/590; 254/4 C, DIG. 4

[56] References Cited

U.S. PATENT DOCUMENTS

| | | | |
|---|---|---|---|
| 2,672,319 | 3/1954 | Nelson | 414/10 |
| 2,677,580 | 5/1954 | Minzenmayer | 414/10 X |
| 2,794,687 | 6/1957 | Harlan et al. | 414/11 X |
| 2,969,220 | 1/1961 | Spencer | 254/4 C |
| 3,923,167 | 12/1975 | Blankenbeckler | 414/11 |

*Primary Examiner*—Leslie J. Paperner

[57] ABSTRACT

The invention has hoist means to elevate or lower Panels, such as sheetrock, wall board and plywood and the like, and, exactly place and fit panels of same on the ceilings of rooms in a building. The hoist means is supported on a platform having rollers thereunder to facilitate moving the same about on the floor opposite the ceiling in a room. On top of activated hoist post is an I-frame on top of which is a slidable sliding frame both lengthwise and sidewise activated by rope means wound around a drum whereby said sliding frame may be shifted lengthwise on said I-frame, and, other rope means wound around said drum after freeing the first named rope means from said drum whereby said H-frame is slidable sidewise over said I-frame. The lengthwise and sidewise movement of said sliding frame with panel on top of said H-frame enables the operator to precisely fit one panel after another in juxta position to each other on the ceiling for affixing and nailing said panels to said ceiling of a room quickly and in a more facile way than has ever been done before.

4 Claims, 2 Drawing Figures

PANEL HANGER

The invention relates to improvements in a panel hanger, adapted to be used in rooms of a building for precisely hoisting panels such as sheetrock, wall board, plywood sheets of large size and the like to place said panel in exact juxta position endwide or sidewise to panels already fixed to the ceiling in said room.

An object of the invention is to provide a hoisting device mounted on wheeled platform of the character described which has I-frame on top of hoist means with sliding frame movable over I-frame lengthwise and sidewise with panel superimposed over sliding frame to quickly and accurately make fine adjustment to cause the panel to be paced endwise in juxta position to the end of a panel already in fixed position on the ceiling of a room.

Another object of the invention is provide a hoisting device mounted on wheeled platform of the character described which has I-frame on top of hoist means with sliding frame movable over I-frame lengthwide and sidewise with panel superimposed over sliding frame to quickly and accurately make fine adjustment to cause the panel to be placed sidewise laterally in juxta position to the side edge of a panel already in fixed position on the ceiling of a room.

These and other objects of the invention are in part obvious and will in part be more fully disclosed in the specification, one embodiment of which is illustrated in the accompanying drawings, in which.

Figure 1:
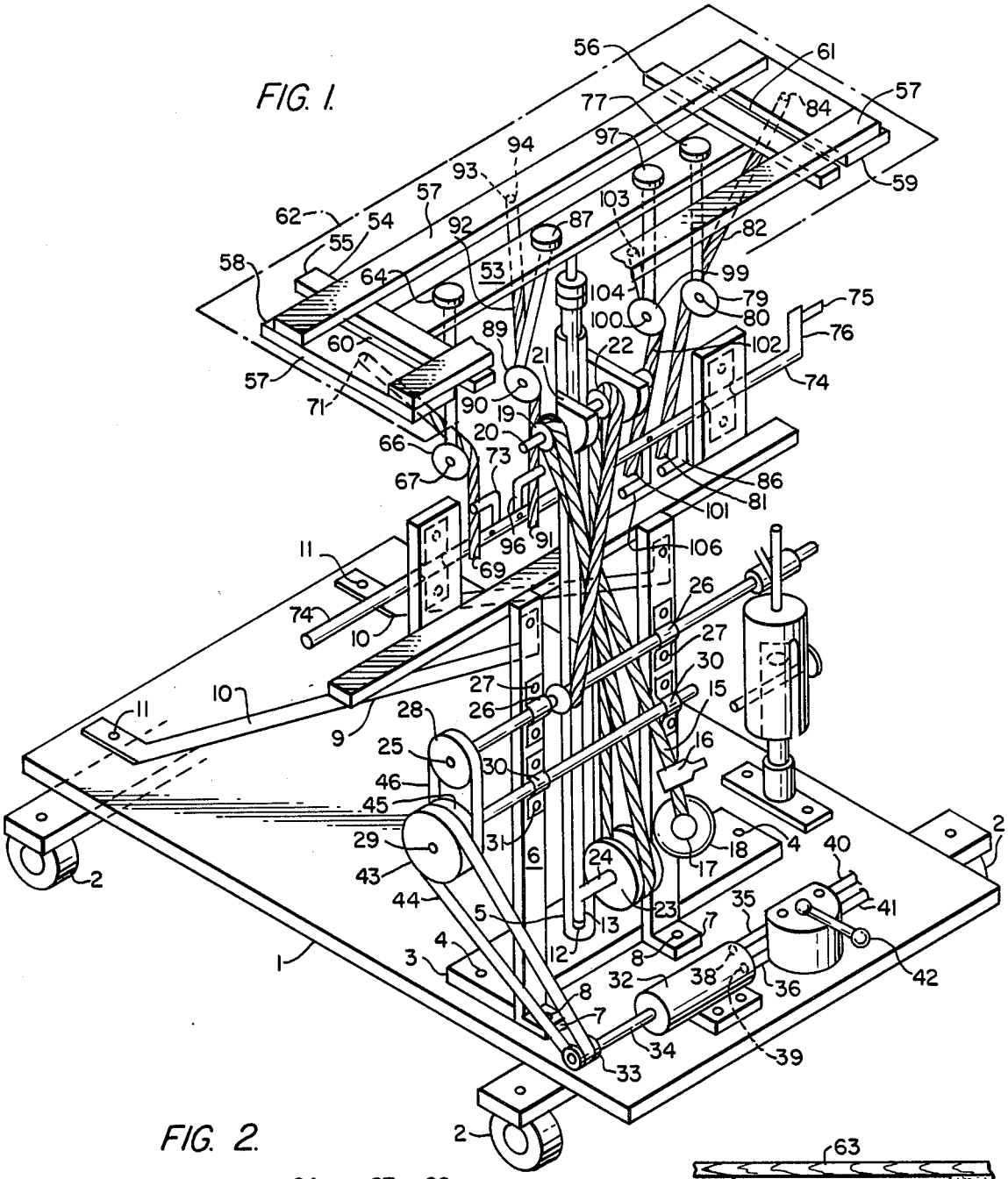
FIG. 1 is a perspective view of the invention in elevation, showing hoist means mounted on wheeled platform with wire rope means laced around pulleys or sheaves with I-frame mounted on hoist means and sliding frame slidably mounted over I-frame with panel superimposed over sliding frame.

The numeral 1 denotes movable platform 1 with rollers 2 (four in number) on which said platform may be easily rolled by hand around on the floor of a room in a building the ceiling of which is to be covered by a panel of sheetrock, wall board, plywood or the like. Mounted on said platform is a plate 3 bolted by two bolts 4-4 to the top surface of said platform which supports the hoisting device and its attachments used to place and fitpanels in position one to the other for covering said ceiling.

A split vertically positioned pipe 5 is secured centrally of said plate 3 in upright position. Forward of said plate 3 is two vertical parallel posts 6-6 with feet 7-7 bolted to the platform 1 by two bolts 8-8 and the top ends said vertical posts 6-6 are joined together by cross support 9. The rear side of cross support 9 has two braces 10-10 attached thereto and the lower ends of said braces 10-10 are bolted by two bolts 11-11 to said platform 1 near the rear end thereof.

Said vertical split pipe 5 has vertical split slot 12 which extends from the top of said pipe 5 down near the lower end thereof and leaving the bottom of said pipe 5 as a solid tube near its lower end. Said vertical split pipe 5 is the outer pipe inside of which inner pipe 13 slides up and down therein when activated as a hoist means by wire rope means 14. Said wire rope means has its lower end 15 inserted and held by clamp 16 through eyelet 17 of lug 18 which is attached to right post 6 to form dead line of the wire rope assembly used as part of the hoist means. Said wire rope lower end 15 extends upwardly and is threaded behind and forwardly around sheave 19 mounted and rotatable on left end of horizontally positioned support pin 20 which extends through bracket arms 21-21 welded on opposed sides of said vertical slot 12 near the upper end of said split outer pipe 5 with equal amount of support pin carrying sheave 22 on the right end of said support pin 20. Thence said wire rope 14 extends dowwardly from sheave 19 and is threaded forwardly and around travelling sheave 23 which is rotatably mounted on travel pin 24 whose lower end is bent, and, attached to the inner travelling pipe 13 near the lower end thereof. Thence said wire rope 14 extends upwardly behind and forwardly around sheave 22 and thence downwardly and coiled around hoist drum shaft 25 which is supported through journal boxes 26-26 attached by bolts 27 (4 in number) to the vertical posts 6-6. The hoist shaft has sheave 28 connected to the left end thereof. A horizontally positioned jack shaft 29 is mounted through journal boxes 30-30 attached by bolts 31 (4 in number) to vertical posts 6-6. A reversible electric motor 32 is mounted on forward end of platform 1 with sheave 33 attached to the outer end of its armature shaft 34 and electric wire 35 is attached to said motor 32 and electric wire 36 is attached to electric motor 32 and the other ends of said electric wires 35 and 36 are attached to terminal posts 38 and 39 respectively. The switch 37 has connecting electric wires 40 and 41 respectively to the terminals of said switch 37 as the source of electric energy to operate said electric motor 32. The handle 42 of switch 37 when turned to right will cause electric motor to turn said armature shaft to the right, and, upon turning handle 42 to the left will cause the electric current from source to turn said armature shaft to the left. Thus the electric motor 32 to be used as a reversible motor. The jack shaft 29 has sheave 43 on the left end thereof. A belt 44 is threaded around and connects sheave 33 on end of armature shaft 34, and, sheave 43 on end of jack shaft 29. An inner sheave 45 is mounted inside sheave 43 on jack shaft 29 and a belt 46 is threaded around and connects said inner sheave 45 on jack shaft 29 and sheave 28 on drum shaft 25. Thus on turning handle 42 to the left said motor will turn to the left and cause the armature shaft 34, sheave 33, sheave 43 sheave 45 and sheave 28 by connected belt means 44 and 46 to cause wire rope 14 to wind up around drum shaft 25 and cause travelling sheave 23 and its travel pin 24 to raise inner pipe 5 up through slot 12 in outer vertical pipe 6.

Figure 2:
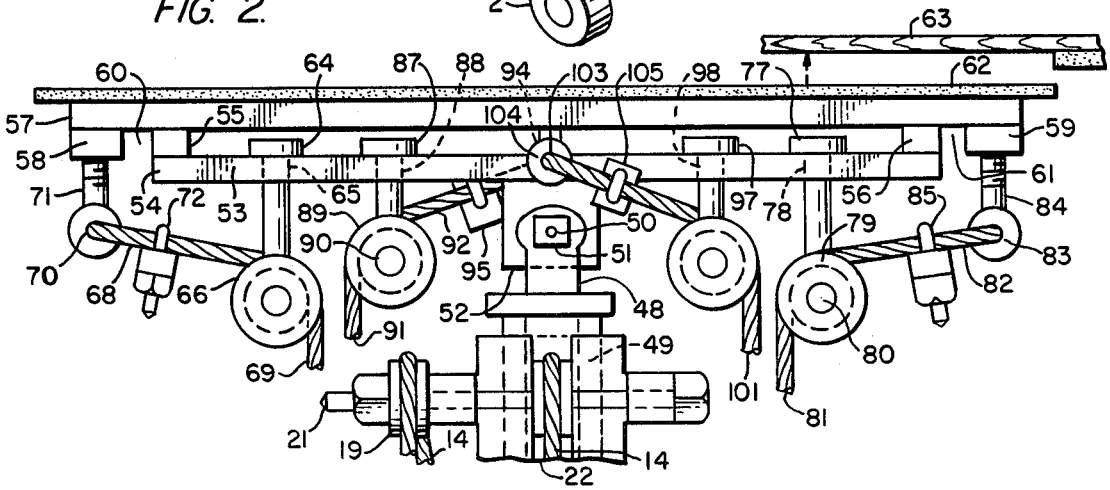
FIG. 2 is an enlarged end view of the top of the hoist means with side edge view of I-frame mounted thereon and sliding frame mounted over I-frame with panel of sheetrock superimposed over top of sliding frame showing panel being placed in exact endwise postion to a panel already in fixed position on ceiling.

The upper end of inner pipe 13 has a vertical post 48 extending into hole 49 in the top part of inner pipe 13. The upper end of said vertical post 48 is connected by pivot pin 50 and nut 51 to lug 52 attached to the bottom side of rib 53 of I-frame 54 whose cross flanges 55 and 56 with rib 53 form said I-frame. Mounted on the top of I-frame 54 is sliding frame 57 whose flanges 58 and 59 provides spaces 60 and 61 between the inner edges of said flanges 58 and 59 of the sliding frame 57 and the cross flanges 55 and 56 of said I-frame so that lenghtwise movement of H-frame is provided as hereinafter more fully explained. Also said sliding frame can be moved laterally sidewise over I-frame to place and fit a panel 62 in position to an adjoining panel already in place on the ceiling 63 of a room in a building all as illustrated in FIG. 2 of the drawing.

A headed hanger rod 64 extends through hole 65 and extends below rib 53 of I-frame 54 carrying a sheave 66 mounted on pin 67. End 69 of wire rope 68 extends up over sheave 66 and is tied off through eyelet 70 of eye bolt 71 and held by clamp 72 as shown in FIGS. 1 and 2 of the drawings. The lower end 69 of wire rope 68 is laced under lug 73 and may be coiled around drum 74 shown in FIG. 1 of the drawing and upon manually turning handle 75 on throw 76 to the right, said wire rope 68 will spool up around drum 74 pulling the cross flange 58 to the right thus sliding movable sliding frame lengthwise to the right over I-frame 54 to adjust said panel 62 into position endwise to place panel 62 into juxta position with the end of another panel already in place fixed to ceiling 63 as shown in FIG. 2 of the drawings.

A headed hanger rod 77 extends through hole 78 and extends below rib 53 of I-frame 54 and carrying a sheave 79 mounted on pin 80. End 81 of wire rope 82 extends up and over sheave 79 and is tied off through eyelet 83 of eye bolt 84 and held by clamp 85 as shown in FIGS. 1 and 2 of the drawings. The lower end 81 of wire rope 82 is laced under lug 86 and may be coiled around drum 74 and upon manually turning handle 75 on throw 76 to the left, said wire rope 82 will spool up around drum 74 pulling the cross flange 59 of sliding frame 57 lengthwise to the left, thus sliding movable sliding frame to the left over I-frame 54 to adjust said panel 62, if need be, into position if platform 1 is not lined up perfectly so that a panel superimposed on movable sliding frame will fit endwise to another panel already in place on said ceiling 63.

Another headed hanger rod 87 extends through hole 88 and extends below rib 53 of I-frame 54 and carrying a sheave 89 mounted on pin 90. End 91 of wire rope 92 extends up and over sheave 89 and is tied off through eyelet 93 of eye bolt 94 and held by clamp 95 as shown in FIGS. 1 and 2 of the drawings. The lower end 91 of wire rope 92 is laced under lug 96 and may be coiled around drum 74 and upon manually turning handle 75 on throw 76 to the right, said wire rope 92 will spool up around drum 74 pulling the sliding frame 57 laterally sidewise to the right, thus sliding movable sliding frame 57 laterally sidewise to the right over I-frame 53 to adjust said panel 62 superimposed on top of sliding frame 57 into position sidewise to place panel 62 into juxta position with side edge of another like panel already in place fixed to ceiling 63.

Another headed hanger rod 97 extends through hole 98 and extends below rib 53 of I-frame 54 and carrying sheave 99 mounted on pin 100. Lower end 101 of wire rope 102 extends up and over sheave 99 and is tied off through eyelet 103 of eye bolt 104 and held by clamp 105 as shown FIGS. 1 and 2 of the drawings. The lower end 101 of wire rope 102 is laced under lug 106 and coiled around drum 74 and open manually turning handle 75 on throw 76 to the right, said wire rope 102 will spool up around drum 74 pulling the sliding frame 57 laterally sidewise to the left, thus sliding movable sliding frame 57 laterally sidewise to the left over I-frame 53 to adjust said panel 62 superimposed on top of sliding frame 57 into position sidewise to place panel 62 into juxta position with side edge of another like panel already in place fixed to ceiling 63.

It is to be understood that the lower end 69 of wire rope 68, the lower end 81 of wire rope 82, the lower end 91 of wire rope 92, and, the lower end 101 of wire rope 102 are laced under the respective lugs 73, 86, 96 and 106 at selective single times by the operator in order to move said sliding frame 57 into the respective positions over I-Frame 53, that is, using wire rope 68 only to move said sliding frame 57 laterally lengthwise to the right; using wire rope 82 only to move said sliding frame 57 laterally lengthwise to the left; using wire rope 92 only to move said sliding frame 57 laterally sidwise to the right; and, using wire rope 102 only to move said sliding frame 57 laterally sidewise to the left over I-Frame 53 to position said panel 62 into juxta position to another like panel already in place fixed to said ceiling 63.

It is obvious that many changes may be made in details of construction and arrangement of the various parts of the invention without departing from the spirit and scope of the invention.

Having thus described the invention, what is claimed as new and desire to secure by Letters Patent is:

1. In a panel hanger device having hoist means to elevate panels of building materials to the ceiling of a room including an I-frame mounted on top of said hoist means, drum shaft means, a wire rope coiled around said drum shaft means to elevate or lower said I-frame means, a sliding frame mounted on said I-frame with a panel mounted on said sliding frame, said drum means adapted to rotate and coil said wire rope means around said drum means to shift said sliding frame lengthwise to the right with said panel thereon over said I-frame controlled by said wire rope means wound around said drum means to place said panel in juxta position to the end of a panel already affixed to said ceiling.

2. In a panel hanger device having hoist means to elevate and lower panels of building materials to the ceiling of a room including an I-frame mounted on top of said hoist means, drum shaft means, a wire rope coiled around said drum shaft means to elevate and lower said I-frame means, a sliding frame movably mounted on said I-frame with a panel mounted on said sliding frame, said drum means adapted to rotate and coil said wire rope means around said drum means to shift said sliding frame lengthwise to the left with said panel thereon over said I-frame controlled by said wire rope means wound around said drum means to place said panel in juxta position to the end of a panel already affixed to said ceiling.

3. In a panel hanger device having hoist means to elevate panels of building materials to the ceiling of a room including an I-frame mounted on top of said hoist means, drum shaft means, a wire rope coiled around said drum shaft means to elevate said I-frame means, an sliding frame mounted on said I-frame with a panel mounted on said sliding frame, said drum menas adapted to rotate and coild said wire rope around said drum neans to shift said sliding frame laterally sidewise to the right with said panel thereon over said I-frame controlled by said wire rope means wound around said drum means to place said panel in juxta position to the side edge of a panel already affixed to said ceiling.

4. In a panel hanger device having hoist means to elevate panels of building materials to the ceiling of a room including an I-frame mounted on top of said hoist means, a drum shaft means, a wire rope coiled around said drum shaft means to elevate said I-frame means, sliding frame movabley mounted on said I-frame with a panel mounted on said sliding frame, said drum means adapted to rotate and coil said wire rope around said drum means to shift said sliding frame laterally sidewise to the left with said panel thereon over said I-frame controlled by said wire rope means wound around said drum means to place said panel in juxta position to the side edge of a panel already affixed to said ceiling.

* * * * *